US007070250B2

(12) United States Patent
Lester et al.

(10) Patent No.: US 7,070,250 B2
(45) Date of Patent: Jul. 4, 2006

(54) MODULAR PRINTING SYSTEM

(75) Inventors: Samuel M. Lester, Boise, ID (US); Jimmy Sfaelos, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 240 days.

(21) Appl. No.: 10/706,387

(22) Filed: Nov. 12, 2003

(65) Prior Publication Data

US 2005/0099438 A1 May 12, 2005

(51) Int. Cl.
*B41J 3/00* (2006.01)

(52) U.S. Cl. ..... 347/4; 347/5

(58) Field of Classification Search ..... 347/4
See application file for complete search history.

(56) References Cited

U.S. PATENT DOCUMENTS 5,781,823 A * 7/1998 Isobe et al. ..... 399/2
5,901,276 A * 5/1999 Murahashi et al. ..... 358/1.13
6,151,037 A * 11/2000 Kaufman et al. ..... 347/2
6,192,397 B1 * 2/2001 Thompson ..... 709/209
6,234,331 B1 5/2001 Brandenberg
6,244,699 B1 6/2001 Brugue et al.
6,336,718 B1 1/2002 Blanchard, Jr. et al.
6,409,321 B1 6/2002 Brugue et al.
6,517,179 B1 2/2003 Hinojosa et al.
2004/0066535 A1 * 4/2004 Oyumi ..... 358/1.15

* cited by examiner

*Primary Examiner*—Thinh Nguyen
*Assistant Examiner*—Brian J. Goldberg

(57) ABSTRACT

Embodiments of the present invention provide a modular printing system. In one embodiment, the modular printing system includes a first printer and a second printer. The modular printing system further includes a connector system adapted to interchangeably connect the first printer to the second printer and a control link adapted for communications between the first printer and the second printer to process a print job without user intervention.

19 Claims, 8 Drawing Sheets

MODULAR PRINTING SYSTEM

BACKGROUND OF THE INVENTION

Printer technology is continually advancing, resulting in commercially available printers with increasing speed, print quality features, etc. A wide range of printers are commercially available, ranging from relatively inexpensive "printing press" models with few features to more expensive "printing press" models with many features and expandable options enabling the user to print anything from a simple monochrome report to a colorful photo quality publication. Most print jobs, however, fall somewhere in between and the more expensive color printers, for example, are too expensive to maintain for printing simpler monochrome business documents. Thus, resources are wasted unnecessarily.

Additionally, print jobs often require the use of multiple printers to process large print jobs or take advantage of unique features of a printer such as photo quality color printing. Most users, however, find it extremely costly and inefficient to print, for example, a primarily monochrome print job on a color printer. Doing so is time consuming as color printers are much slower and more expensive to maintain. To process a print job that has both a monochrome portion and a color portion, the print job must be apportioned by the user and the user must send the monochrome portion to a monochrome printer and the color portion to a color printer.

Moreover, although many printers either include or can be expanded to include additional features by adding input/output (I/O) devices to a single printer, multiple printers cannot be joined to create a physical path of the paper from one printer to another. The physical path of the paper is typically referred to a "print path" or "print media path." Thus, when more than one printer is needed to process a print job, a user must also manually transfer print media from one printer to another until the print job is completed.

SUMMARY OF THE INVENTION

Embodiments of the present invention provide a modular printing system. In one embodiment, the modular printing system includes a first printer and a second printer. The modular printing system further includes a connector system adapted to interchangeably connect the first printer to the second printer and a control link adapted for communications between the first printer and the second printer to process a print job without user intervention.

BRIEF DESCRIPTION OF THE DRAWINGS

Embodiments of the invention are better understood with reference to the following drawings. The elements of the drawings are not necessarily to scale relative to each other. Like reference numerals designate corresponding similar parts.

DETAILED DESCRIPTION

Figure 1:
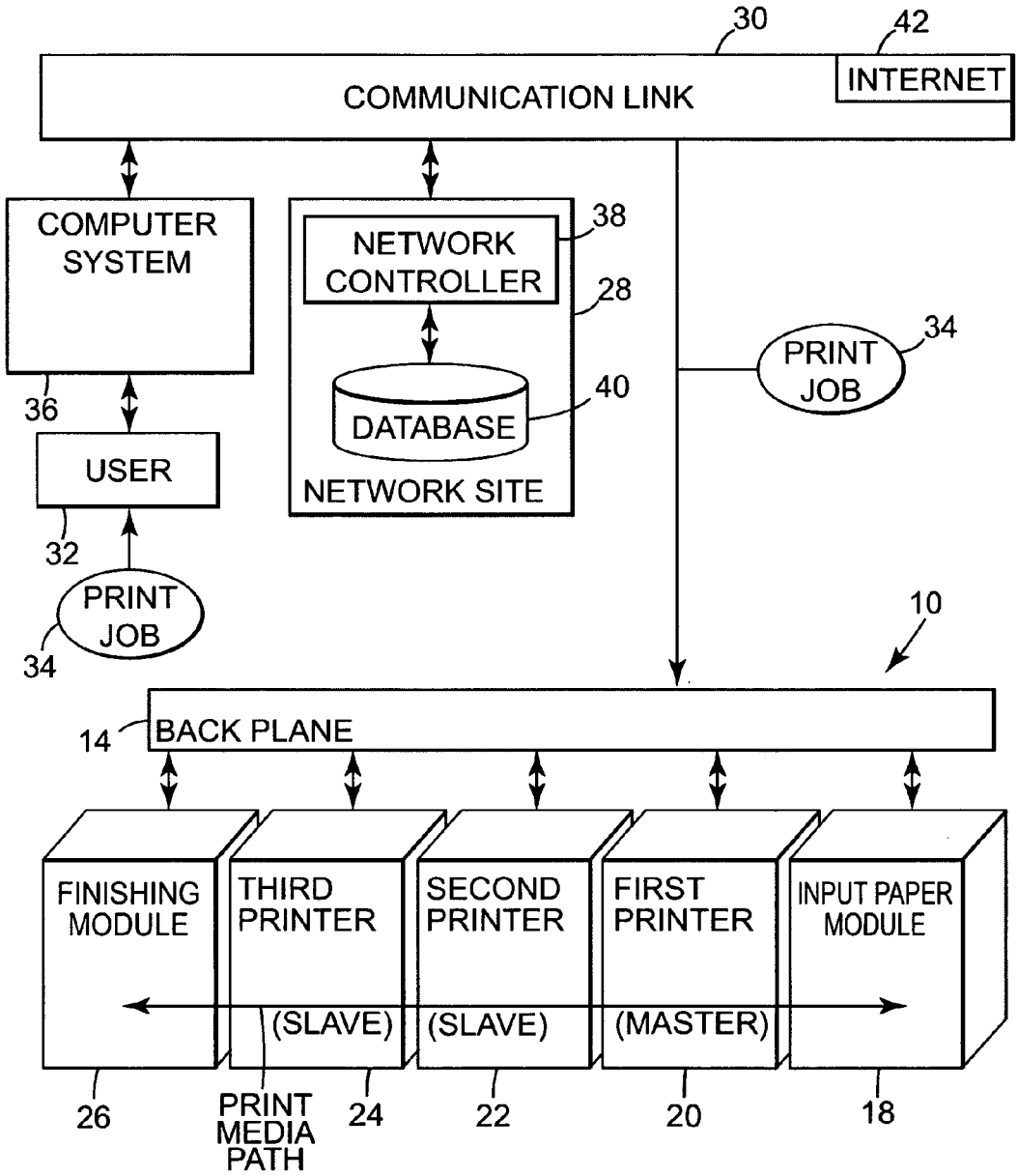
FIG. 1 is a diagram illustrating an exemplary embodiment of a modular printing system.

FIG. 1 illustrates one exemplary embodiment of a modular printing system in accordance with the principles of the present invention. Modular printing system 10 includes a plurality of printers and a control link 14. Each printer includes at least one controller, such as a microprocessor, for controlling the functions of the printer and for communicating with the other printers over control link 14. In one embodiment, control link 14 is termed a "back plane," which includes a connector system that interchangeably connects the plurality of printers. Back plane 14 is formed when individual and independent control links of the plurality of printers are combined by connecting them to each other via the connector system. Back plane 14 is a communication conduit that allows the printers to communicate with each other.

The term "printer," as used herein, refers to any type of device that can produce an image (such as letters, pictures, drawings, etc.) on or in media (such as paper, plastic, fabric, etc.). Such devices may include impact printers, non-impact printers, such as inkjet printers or laser printer, digital copiers, analog copiers, facsimile machines, press machines, silk screen machines, etc. Printers can produce images in any of a wide variety of conventional print media (e.g., paper, plastic, fabric, etc.); however, for ease of discussion printers are discussed herein in the context of printing to paper.

The term "input module," as used herein represent any of a wide variety of print media source devices and pre-processing devices. Examples of input modules include a device with one or more paper trays for supplying one or more sizes or types of paper or other print media to a printer; a pre-processing device to put a "stamp" on each sheet of paper prior to printing (such as physically adding a stamp to the sheet of paper or adding a graphical image or text to the data for each page); a paper separating device to separate fan-folded media into separate sheets or to cut a sheet of paper from a roll of paper; a device to affix another piece of paper to the sheet for printing to (e.g., a self-stick, removable note); a device to flip a sheet of paper or otherwise change its orientation; a hole-punching device to punch a hole(s) in each sheet of paper; a scanning device, such as to obtain a serial number from a sheet of paper or verify that pre-printed media is oriented correctly for printing; or to provide print data as in the case of a digital copying machine; etc.

The term "finishing module," as used herein includes any of a wide variety of routing and finishing devices. Examples of finishing modules include a paper sorter; a paper folder; a stapler; a hole punch; a gluing/binding device; a booklet maker to organize, fold, and bind the output as appropriate for a booklet; a device to stuff paper into an envelope and optionally seal the envelope; a device to add job dividers (e.g., covers or colored paper); a shrink wrap device to wrap printed sheets; a device to add tabbed sections to dividers; a perforating device to perforate printed sheets; a laminator to laminate all or part of a sheet (e.g., only the tabs); a mailbox device with different locations to receive printed sheets for different individuals, an embosser to emboss printed sheets; a device to remove pieces of paper affixed to the sheet of paper for printing (e.g. Post-It Notes); a device to affix ink from a just-printed to transfer media onto cloth (e.g., iron onto a T-shirt); a shredder; etc.

The term "printer" as used herein refers to printers, input modules, and finishing modules.

Modular printing system 10 may include any combination of printers. The printers may function independent of one another as separate stand alone printers. When the printers are coupled together, the printers function as a unified printing system rather than as separate stand alone printers. Modular printing system 10 is configured by adding printers to or removing printers from modular printing system 10 by coupling and uncoupling printers via the connector system.

Modular printing system 10 includes input modules, printers, and finishing modules. The user may choose any combination of input modules, printers and finishing modules to form modular printing system 10. When more than one printer is included in modular printing system 10, the printers automatically negotiate a master/slave relationship between themselves via back plane 14. In another embodiment, a printer may arbitrarily be designated as the master for modular printing system 10. If the printers have similar attributes, any one of the printers may be designated as the master. In another embodiment, the master/slave relationship is automatically negotiated based on varying attributes (e.g., extra fonts, greater processing power, faster print speed, etc.). If a single printer is connected to one or more other printers that are not printers, the single printer will be automatically designated as the master and the other printers will be designated as slaves. If more than one printer is connected to one or more other printers, the printer with superior processing power will be automatically designated as the master and the remaining printers will be designated as slaves.

The master/slave relationship may be automatically negotiated by the controllers of the printers using a process programmed into the printers. The controller of each printer will use the process to calculate a value representing the summation of the printer's attributes for acting as the master. The printer with the highest value will be designated the master and the remaining printers will be designated as slaves. In the event two or more printers have the same highest value, each printer will generate a random value and the printer with the highest random value will be designated as the master.

The printer attributes for the algorithm may be weighted by their importance as a tool to a master in overall print job processing throughput. Each attribute may be weighted by its importance to one or more of the following: reading and storing each incoming print job, determining resource requirements for each incoming print job, selecting either a single printer or several printers to complete the print job, redirecting the print job to a single module or subdividing the print job into portions, sending each print job portion to the correct printer, and sequencing each printer output to output a completed print job to a single module output bin(s) or tray(s).

Attributes of each printer may include the controller type, memory type, available I/O, and additional circuits. Controller type may include controller speed, amount of instruction and memory cache, and programming language word size (e.g. 32, 64, 128 bits or more). The memory type may include memory speed and whether the memory is single or multi ported. Multi ported memory is memory in which more than one processor can read and write the memory at a single moment in a controlled fashion and prevent corrupted data. Available I/O includes I/O either built into the controller or attached to the controller through plug in circuit cards. Additional circuits include attached image processing circuit cards or application specific integrated circuits (ASICs) that may allow hardware processing of repetitive Postscript, JPEG, TIFF, Font, etc. commands.

Each slave printer within modular printing system 10 that receives a print job through their own printer I/O, user interface, or other print job input device, such as a digital scanner, may redirect the incoming print job directly to the master printer. The master printer will then process the incoming print job.

Each slave printer may provide a capability listing to the master print device. The capability listing and the master printer's own capabilities will be compared against incoming print job resource requirements. The master printer can either parse the incoming print job to determine the print job resource requirements or the print job could include a list of the print job requirements at the beginning of the print job in the same or similar format as the capability listings from each slave printer. Preferably, the incoming print job lists the resource requirements for the entire print job combined and lists the resource requirements separately for each page of the print job.

The master printer uses the capability listings from the slave printers and the incoming print job resource requirements to: direct the incoming print job to the printer best suited to fully complete the incoming print job; partition, if necessary, the incoming print job among the slave printers on a page by page basis; feed the required print media to the printers; and direct the printed print media to the output device with the necessary finishing capabilities to complete the print job.

If modular printing system 10 includes more than one printer capable of completing the print job, then the master printer selects the printer that requires the shortest print media path. Selecting the printer with the shortest print media path reduces the number of printers that must be turned on to pass print media through. For example, if the modular printing system 10 consists of three equal printers, each able to complete the incoming print job, and one stapler module, and the incoming print job requires stapling, the master will send the print job to the printer that is directly connected to the stapler. This will result in the shortest and quickest print media path to complete the print job and reduce print job costs by leaving the other two printers idle. By leaving the other two printers idle, the other two printers consume less electrical power and use less of their estimated lives. In addition, the reliability of modular printing system 10 is improved because it is less likely to experience a print media jam or other failure when only one of the three printers are used for a single print job.

In the illustrated embodiment, modular printing system 10 includes an input paper module 18, a first printer 20, a second printer 22, a third printer 24, and a finishing module 26. First printer 20 is a color printer with superior processing power relative to the second and third printers 22 and 24. The printers 20, 22, 24 communicate with each other via back plane 14. Back plane 14 is configured for high speed data and communication transfers and electrical power sharing between the printers. Thus, when the printers are coupled together forming back plane 14, the printers communicate with each other to negotiate the master/slave relationship that identifies first printer 20 as the master, and second and third printers 22 and 24 as slaves.

The printers communicate via back plane 14 using a communication bus protocol. For example, the present invention may or may not use a TCP/IP protocol suite for data transport. Other communication bus protocols suitable for use with modular printing system 10 will become apparent to those skilled in the art after reading the present disclosure.

Network site 28 communicates with modular printing system 10 via a communication link 30. A user 32 sends a print job 34 to modular printing system 10 via a computer system 36. In one embodiment, computer system 36 includes an input device such as a keyboard and/or a mouse and a display device such as a monitor. Computer system 36 communicates with network site 28 via communication link 30 to send print job 34 to modular printing system 10. Network site 28 includes a network controller 38 and a database 40. When user 32 sends print job 34 to modular printing system 10, computer system 36 interacts with network controller 38 to transfer print job 34 to database 40 of network site 28. Print job 34 may be stored in database 40 until it can be transferred to modular printing system 10 for processing. Print job 34 is transferred in and out of database 40 via network controller 38.

In one embodiment, network controller 38 includes a server or other microprocessor-based system capable of performing a sequence of logic operations. In addition, network controller 38 may include a microprocessor embedded system/appliance incorporating tailored appliance hardware and/or dedicated single purpose hardware. Network controller 38 facilitates communication between user 32 and modular printing system 10 by tracking and distributing print job 34 to modular printing system 10.

Communication link 30, as used herein, is defined to include an internet communication link (e.g., the Internet), an intranet communication link, or other high-speed communication link. In one preferred embodiment, communication link 30 includes an Internet communication link 42. While the following description refers to Internet communication link 42, it is understood that the use of other network communication links is within the scope of the present invention. In one embodiment, user 32, network site 28, and modular printing system 10 are located remote from each other. Thus, communications between user 32, network site 28, and modular printing system 10 are conducted over Internet communication link 42. It is, however, within the scope of the present invention for network site 28 to communicate with modular printing system 10 in other manners (e.g., via direct or wireless connection).

Figure 2:
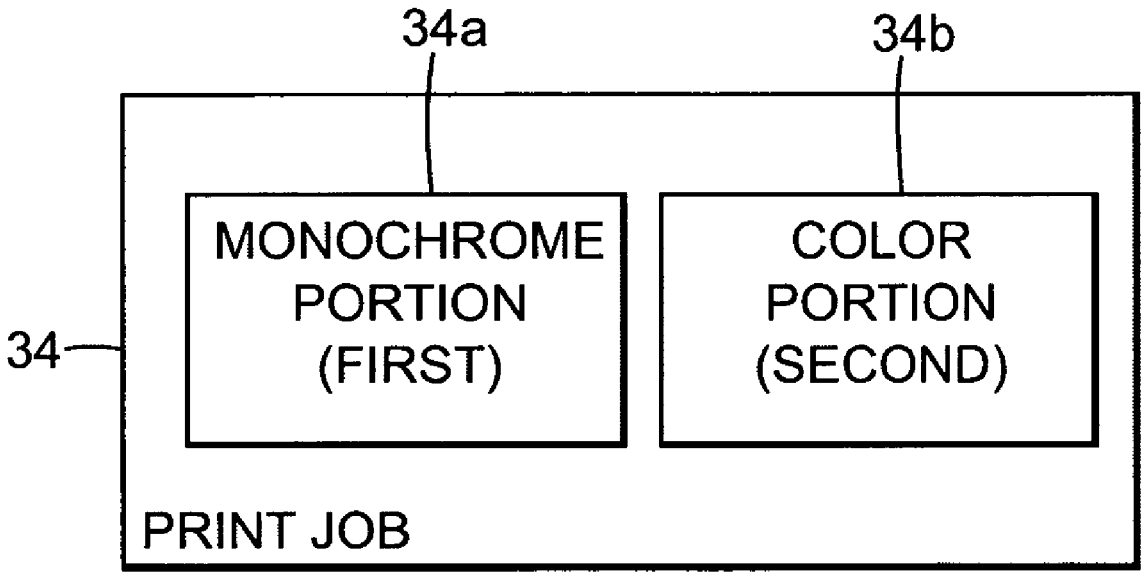
FIG. 2 is a block diagram illustrating an exemplary embodiment of a print job sent to a modular printing system.

FIG. 2 illustrates one exemplary embodiment of print job 34. When print job 34 is received by a master printer, print job 34 is apportioned into a first portion 34*a* and a second portion 34*b*. In another embodiment, the master printer may apportion print job 34 into multiple portions. In the exemplary embodiment, first portion 34*a* is in monochrome while the second portion 34*b* is in color. For example, if first printer 20 is a monochrome printer while second and third printers 22 and 24 are color printers, modular printing system 10 operates to print both first monochrome portion 34*a* and second color portion 34*b* automatically by apportioning print job 34 according to available printer resources and forwarding each portion of print job 34 to an appropriate printer until print job 34 is completed. In one embodiment, first monochrome portion 34*a* and second color portion 34*b* may be portions of a single page. For example, second portion 34*b* may be a color header for business stationary while first portion 34*a* may be a body of a letter that needs to be printed in monochrome. In another embodiment, print job 34 may be a large print job with only a few color pages dispersed throughout print job 34. In this example, first portion 34*a* is a monochrome portion of the large print job and second portion 34*b* is the few color pages dispersed throughout print job 34.

In both embodiments, modular printing system 10 communicates with network site 28 via first printer 20, which is identified as the master printer and includes a network interface card to transfer print job 34 to modular printing system 10. In one embodiment, as illustrated in FIG. 1, master printer 20 is a monochrome printer and first and second slave printers 22 and 24 are color printers. When first printer 20 receives print job 34 from network site 28, first printer 20 processes print job 34, including monochrome portion 34*a* until it encounters color portion 34*b*, which must be processed by either second or third printer 22 and 24. First printer 20 automatically forwards print job 34, including color portion 34*b* to second or third printer 22 and 24 for processing. Modular printing system 10 automatically load balances print job 34, including portions 34*a* and 34*b*, by directing portions 34*a* and 34*b* of print job 34 to an appropriate printer. Thus, monochrome portion 34*a* is printed on first printer 22 and color portion 34*b* is printed on second printer 22 or third printer 24.

In another embodiment, the print media used for the entire print job 34, including first portion 34*a* and second portion 34*b*, is transferred from one printer to the next of modular printing system 10. Each of the printers executes their respective portions of print job 34 on the print media. Once print job 34, including first portion 34*a* and second portion 34*b*, have been printed, the print media of print job 34 may be transferred to finishing device module 26 for completion of print job 34 and delivery to user 32. Thus, the user is presented with completed print job 34 without having to apportion print job 34 or manually transfer the print media from one printer to another.

Figure 3:
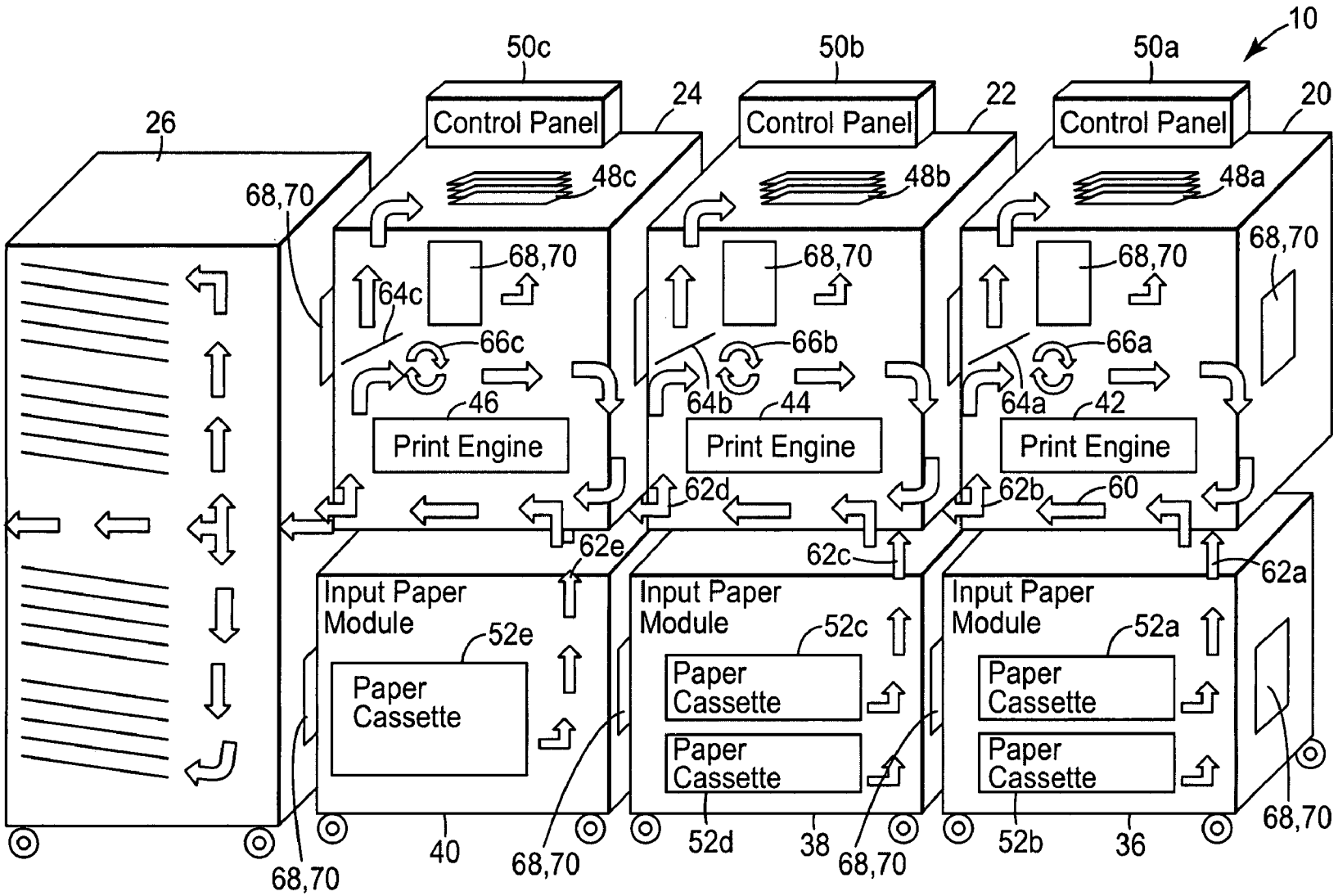
FIG. 3 is a diagram illustrating another exemplary embodiment of the modular printing system.

FIG. 3 illustrates another exemplary embodiment of modular printing system 10 according to the present invention. Modular printing system 10 is coupled together via connector cells 68, 70, which connect to align the printers to form back plane 14 among the printers and align a media path 60 to transfer media between the printers. Modular printing system 10 includes printers 20, 22 and 24 and input paper modules 36, 38 and 40. Each printer 20, 22 and 24 includes a print engine 42, 44 and 46, an output bin 48*a*, 48*b*, and 48*c*, and a control panel 50*a*, 50*b* and 50*c*. Each input paper module 36, 38 and 40 includes at least one paper cassette 52*a*, 52*b*, 52*c*, 52*d*, and 52*e*. In one embodiment, the print media is provided to printers 20, 22, and 24 from the bottom right side of each printer from input paper modules 36, 38 and 40. In another embodiment, the print media is provided to printers 20, 22, and 24 from the lower right side of each printer 20, 22 and 24 from a previous printer of modular printing system 10. For example, the print media is provided to printers 20, 22 and 24 via a print media path 60 illustrated by arrows and inputs 62*a*, 62*b*, 62*c*, 62*d*, and 62*e*. In another embodiment, printers 20, 22, and 24 may also include a diverter 64*a*, 64*b*, and 64*c* to a duplex path indicated by double arrow 66*a*, 66*b*, and 66*c*.

In one embodiment, modular printing system 10 creates a three bin top output stacker by sharing output bins 48*a*, 48*b*, and 48*c*. In another embodiment, modular printing system 10 includes finishing module 26 providing, for example, collating and sorting capabilities. Thus, modular printing system 10 may provide document collation by simply outputting the print media to an appropriate output bin 48*a*, 48*b* and 48*c* as print job 34 is being processed or by directing the print media to finishing module 26. In another embodiment, each printer has unique resources (e.g., fonts, color processing and printing, interpreter language, etc.) that can be shared when the printers are coupled via connector cells 68, 70 to form modular printing system 10.

Figure 4A:
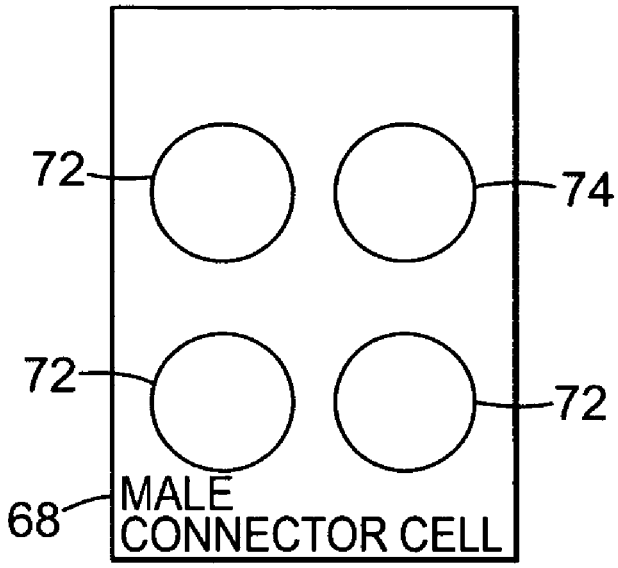
FIG. 4A is a block diagram illustrating an exemplary embodiment of a connector cell for use with a modular printing system.

In one embodiment, each printer is outfitted with plastic moldings comprised of connector cells 68 and 70. FIG. 4A is a diagram illustrating one embodiment of connector cell 68 for use with modular printing system 10. Connector cell 68 is a male connector cell including a plastic fill 72 and a male connector 74. In one embodiment, male connector 74 is an IEEE 1394 Male.

Figure 4B:
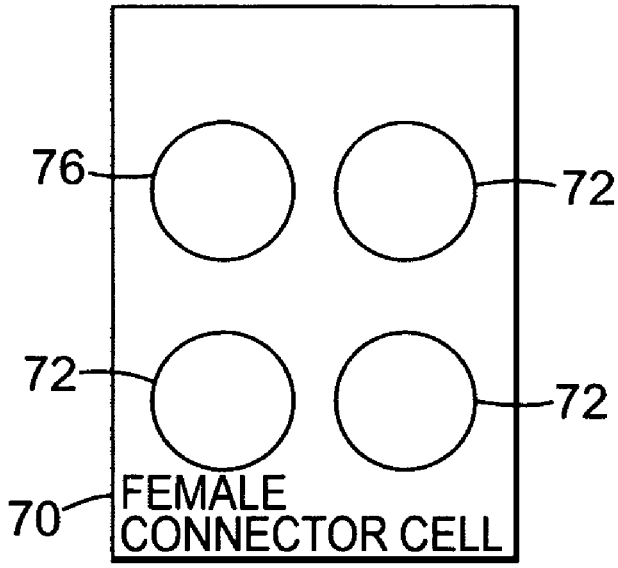
FIG. 4B is a block diagram illustrating another exemplary embodiment of the connector cell for use with a modular printing system.

FIG. 4B is a diagram illustrating one embodiment of a connector cell 70 for use with modular printing system 10. Connector cell 70 is a female connector cell including plastic fill 72 and a female connector 76. In one embodiment, female connector 76 is an IEEE 1394 Female. Female connector 76 of connector cell 68 is coupled to corresponding male connector 74 of connector cell 70 when the printers are coupled together to form modular printing system 10. In one embodiment connector cells 68 and 70 connect to align the printer to form back plane 14 among the printers to allow the printers to communicate with each other and to align print media path 60 between the printers to allow the printers to transfer print media between each other.

Figure 5:
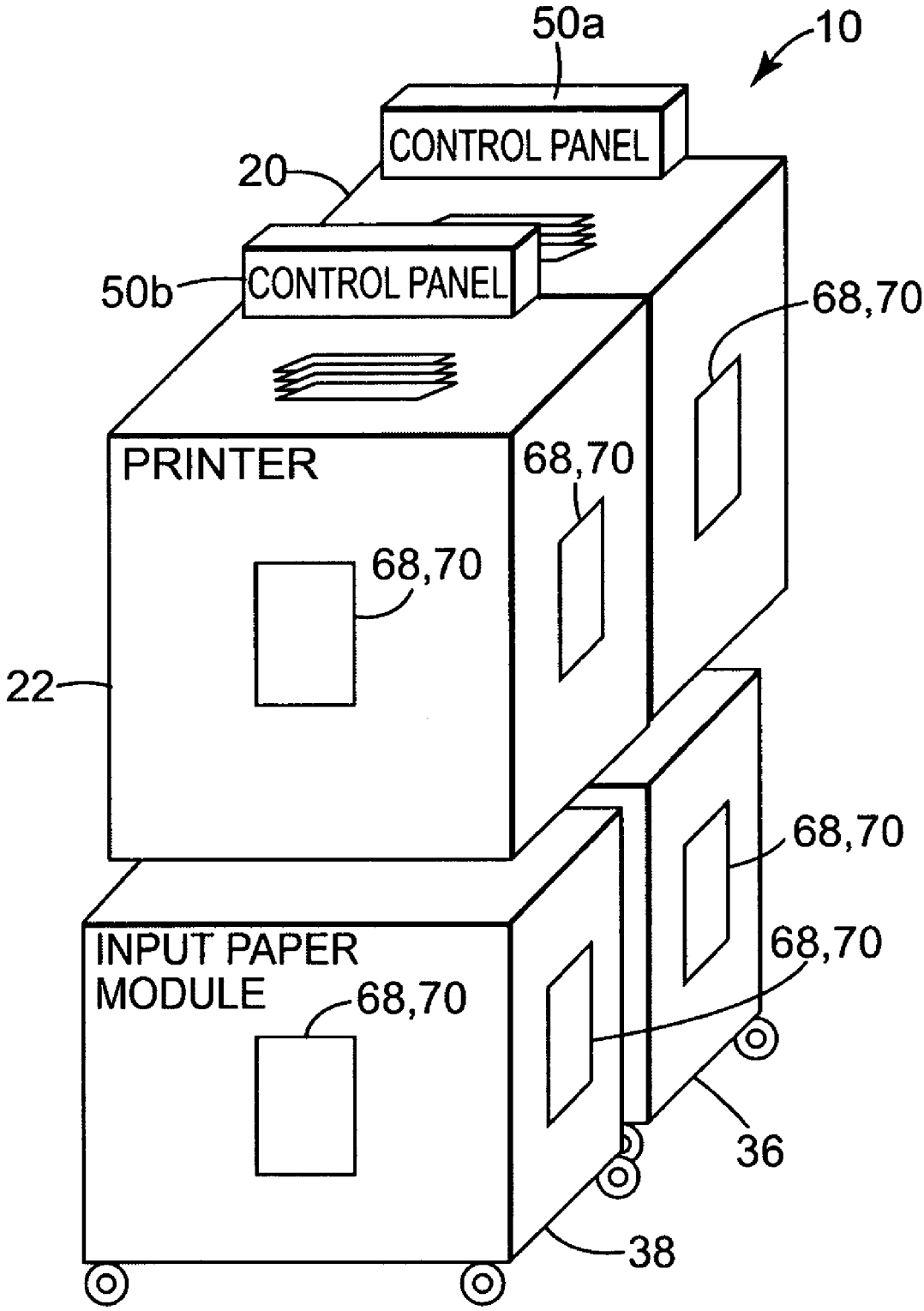
FIG. 5 is a diagram illustrating another exemplary embodiment of a modular printing system.

FIG. 5 illustrates another exemplary embodiment of the modular printing system 10 according to the present invention. Modular printing system 10 includes printers 20 and 22, and input paper modules 36 and 38. Printers 20 and 22 and input paper modules 36 and 38 include the connector cells 68 and 70 that interchangeably connect printers 20, 22, 36 and 38. In one embodiment, connector cells 68 and 70 are located on the front, back and sides of each of the printers. In another embodiment, connector cells 68 are located on the left side and back of printers 20 and 22, while connector cells 70 are located on the right side and front of printers 20 and 22. Thus, the front and back locations of connector cells 68 and 70 allow the printers to be configured sideways or front to back as illustrated in FIG. 5, or side by side as illustrated in FIGS. 1 and 3.

Figure 6:
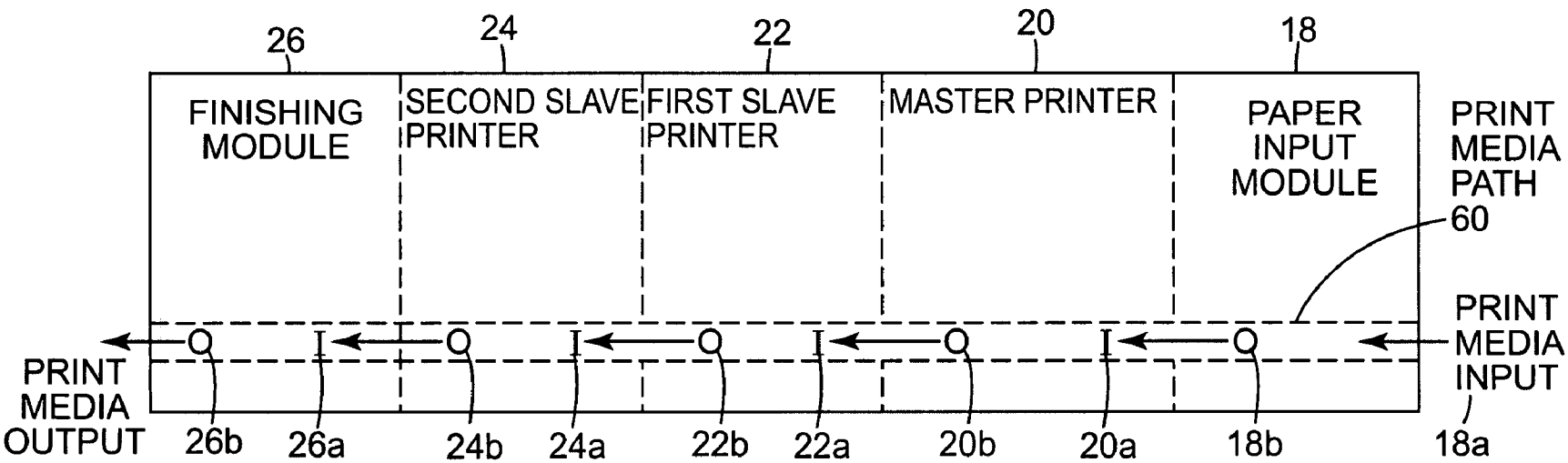
FIG. 6 is a block diagram illustrating an exemplary embodiment of a print media path of a modular printing system.

FIG. 6 illustrates one exemplary embodiment of print media path 60 of modular printing system 10. In one embodiment, the printers of modular printing system 10 are aligned to create continuous print media path 60. Modular printing system 10 includes paper input module 18, master printer 20, first slave printer 22, second slave printer 24, and finishing module 26. Paper input module 18, master printer 20, first slave printer 22, second slave printer 24, and finishing module 26 are aligned such that a print media output (O) of one printer is a print media input (I) of another printer. In one embodiment, for example, print media (not shown) is delivered by paper input module 18 via paper output 18*b*, which feeds the print media directly into master printer 20 via master input 20*a*. Master printer receives print job 34, together with the print media, and executes its portion, if any, of print job 34 on the print media. In one embodiment, master printer 20 then routes print job 34 and the print media to an appropriate printer to execute or complete execution of print job 34. In another embodiment, if master printer 20 does not execute any portion of print job 34, only print job 34 is routed to the appropriate printer for execution. Assuming each printer has the appropriate printer resources to execute a portion of print job 34, the print media is routed through each printer via print media path 60.

In one embodiment, for example, once first portion 34*a* of print job 34 is executed by master printer 20 as described in FIG. 2, the print media is automatically transferred to first slave printer 22 via master output 20*b* directly into a first slave input 22*a* for execution of second portion 34*b* of print job 34. In another embodiment, second portion 34*b* of print job 34 is load balanced between first slave printer 22 and second slave printer 24. Accordingly, print job 34 is also transferred from first slave printer 22 via a first slave output 22*b* directly into a second slave input 24*a*. Once print job 34, including first portion 34*a* and second portion 34*b*, has been printed, modular printing system 10 transfers the printed media of print job 34 via second slave output 24*b* directly into finishing input 26*a* of finishing module 26 to complete print job 34. Once print job 34 is fully executed, print job 34 is delivered to user 32 via finishing output 26*b* of finishing module 26. Thus, modular printing system 10 prints print job 34, including first portion 34*a* and second portion 34*b*, without user 32 having to manually transfer print job 34 from one printer to another printer to print a complex document that includes both a monochrome portion and a color portion.

In another embodiment, each of the printers includes a print media output device (not shown) that allows modular printing system 10 to deliver print job 34 to user 32 through the printers at any point at which print job 34 has been fully executed. For example, if print job 34 is fully executed once master printer 20 has printed print job 34, print job 34 is delivered to user 32 via the print media output device of master printer 20. Thus, the print media is transported uninterrupted and without user intervention via print media path 60 from one printer to the next until print job 34 is fully executed.

Figure 7:
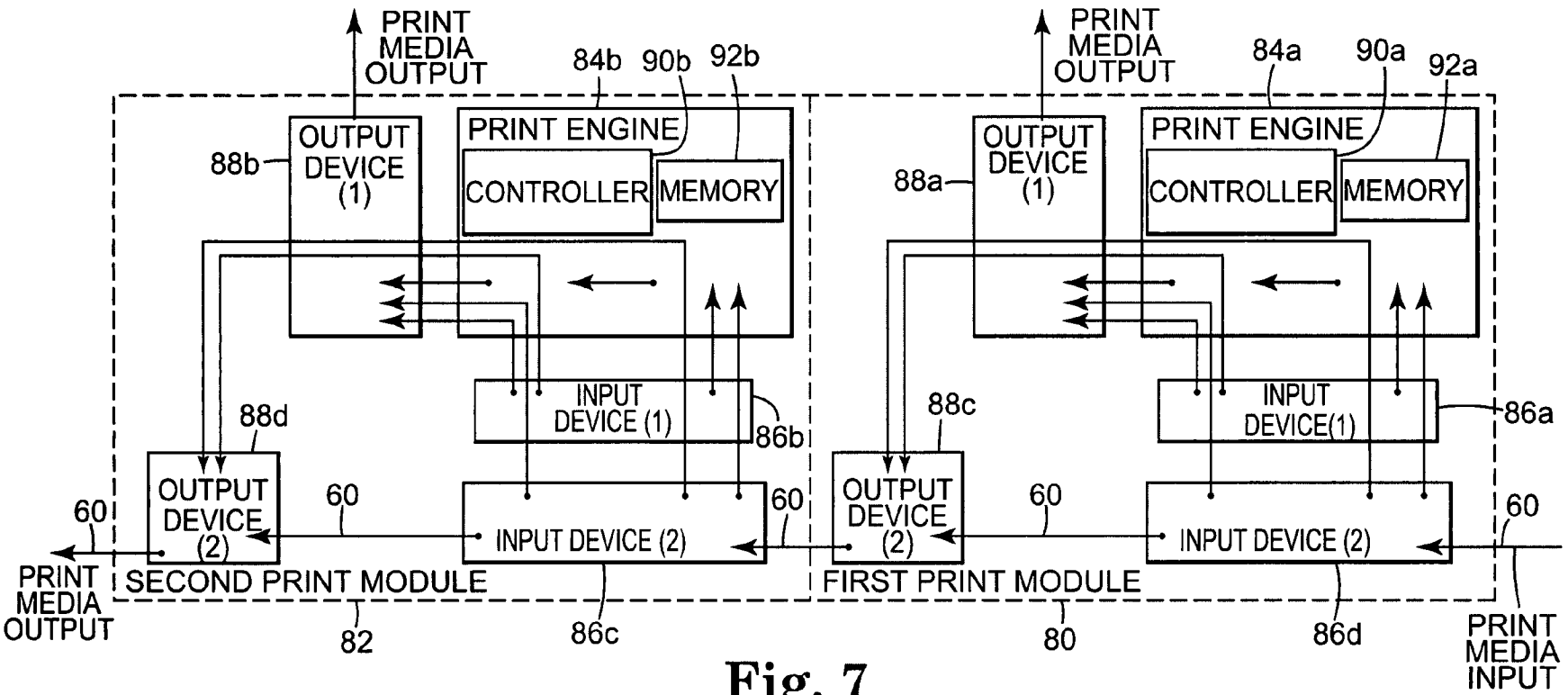
FIG. 7 is a block diagram illustrating an exemplary embodiment of the interface between a first printer and a second printer of a modular printing system.

FIG. 7 is a block diagram illustrating an exemplary embodiment of an interface between two printers in a plurality of printers of modular printing system 10. For ease of discussion, only two printers are illustrated, specifically first printer 80 and second printer 82. In this embodiment, first printer 80 and second printer 82 are printers. First printer 80 is similar to master printer 20. Second printer 82 is similar to first slave printer 22 and second slave printer 24. First printer 80 and second printer 82 include a print engine 84*a*, 84*b*, multiple input devices 86*a*, 86*b*, 86*c*, and 86*d*, and multiple output devices 88*a*, 88*b*, 88*c*, and 88*d*. Input devices 86*a* and 86*b* are print media sources, such as paper trays. Input devices 86*d* and 86*c* are media input paths for manual paper feed or for connection to media output paths, such as output devices 88*c* and 88*d*. Output devices 88*a* and 88*b* are print media outputs, such as output bins 48*a*-48*c* as illustrated in FIG. 3.

During printing, the print media is provided to first printer 80 via print media path 60, as illustrated in detail in FIG. 6, directly into input device 86*d* of first printer 80. Input device 86*d* then provides the print media to print engine 84*a*. In another embodiment, the print media is provided to print engine 84*a* via input device 86*a*. As the print media passes through print engine 84*a* of first printer 80, first portion 34*a* of print job 34 is printed on the print media. After first portion 34*a* of print job 34 is printed by first printer 80, first printer 80 outputs the print media via output device 88*a* of first printer 80. In another embodiment, the print media is routed to output device 88*c*. When the print media is routed to output device 88*c*, the print media is automatically input directly into second printer 82 via input device 86*c* of second printer 82.

In one embodiment, print engines 84*a*, input devices 86*a* and 86*d*, and output devices 88*a* and 88*c* of first printer 80 communicate with one another, transferring control information and data as necessary. Such communication may occur directly between two devices, or alternatively may be routed through print engine 84*a*. Similarly, print engine 84*b*, input devices 86*b* and 86*c*, and output devices 88*b* and 88*d* of second printer 82 communicate with one another, transferring control information and data as necessary. In one embodiment, first printer 80 and second printer 82 include additional components, such as a print head or other mechanism for printing on the print media in print engines 84*a* and 84*b*.

Print engines 84*a* and 84*b* each include a controller 90*a*, 90*b* and a memory/storage device 92*a*, 92*b*. Controller 90*a*, 90*b* negotiates the master/slave relationship between the plurality of printers and controls the transfer of the print media through each printer, including initialization of path identifiers and communication of path identifiers to input devices 86*d* and 86*c*, and output devices 88*a*, 88*b*, 88*c*, and 88*d*. Controllers 90*a* and 90*b* can be implemented in any of a variety of conventional manners, such as using a programmed microcontroller, an ASIC, etc.

Memory 92*a*, 92*b* is a volatile and/or nonvolatile memory, such as random access memory (RAM), read only memory (ROM), a Flash EEPROM (electronically erasable programmable read only memory), a magnetic or optical storage device, etc. Memory 92*a*, 92*b* stores print path identifiers. Suitable print path identifiers for use with the present invention are disclosed in U.S. Pat. No. 6,249,666 B1 to Newell, Jr. et al. for "Print Path Identifiers to Identify Print Medium Paths" issued Jun. 19, 2001, to the assignee of the present invention, and incorporated herein by reference. In one embodiment, memory 92*a*, 92*b* is separate from controller 90*a*, 90*b*. In another embodiment, all or part of memory 92*a*, 92*b* can be incorporated into controller 90*a*, 90*b*.

Figure 8:
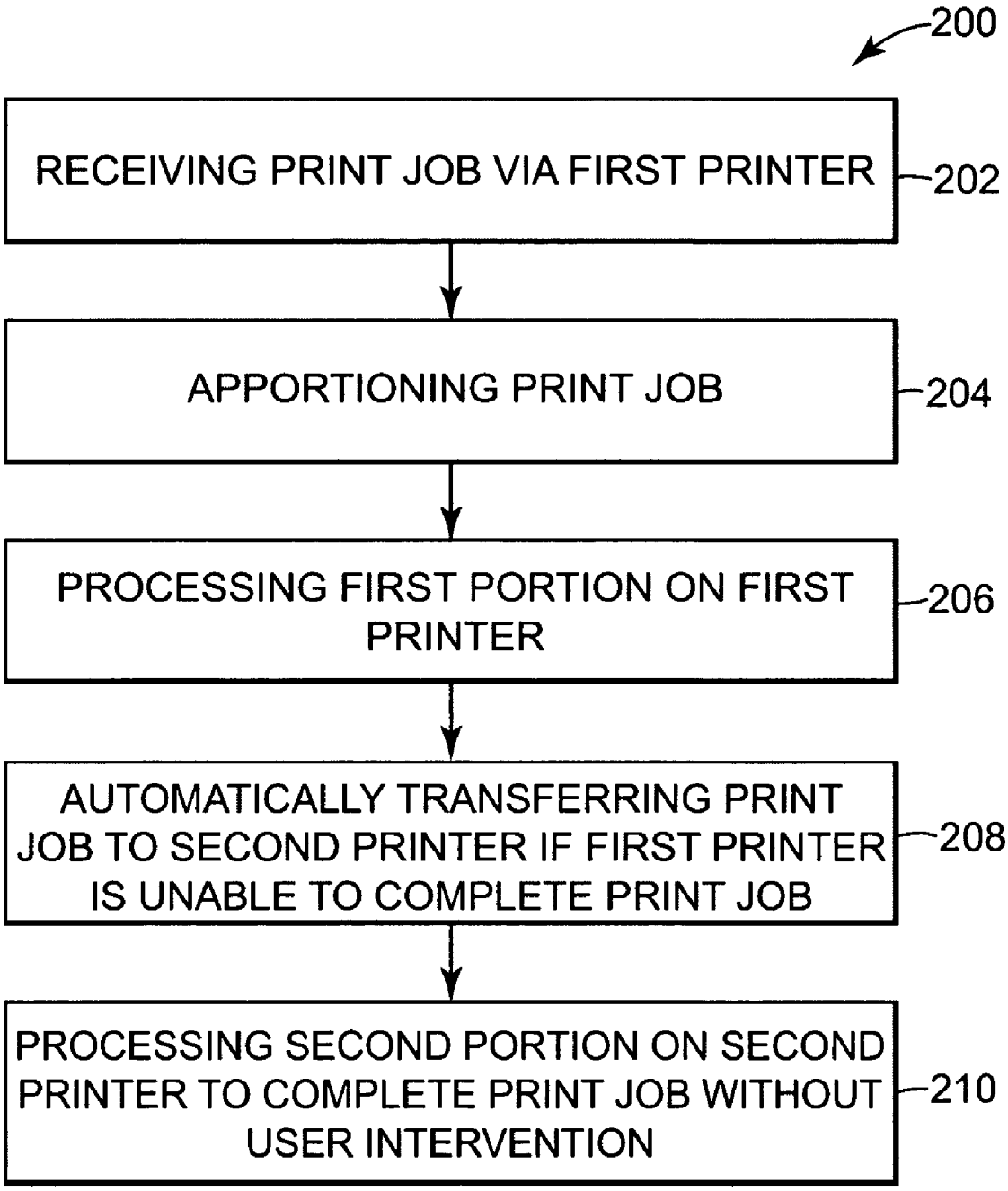
FIG. 8 is a flow diagram illustrating an exemplary embodiment of a method of printing a print job.

FIG. 8 is a diagram illustrating one exemplary embodiment of a method of printing print job 34, having first portion 34*a* in monochrome and second portion 34*b* in color on modular printing system 10. The method of printing print job 34, including first portion 34*a* and second portion 34*b* is illustrated generally at 200. Reference is also made to FIGS. 1–6. At 202, modular printing system 10 receives print job 34 having first monochrome portion 34*a* and second color portion 34*b*. Modular printing system 10 receives print job 34 having portions 34*a* and 34*b* via a first printer. In the embodiment illustrated in FIG. 1, the first printer is first printer 20, which has been identified as the master printer via the master/slave negotiation process. First printer 20 includes a network interface card. At 204, when the first printer receives print job 34 from network site 28, the first printer apportions print job 34.

In one embodiment, the first printer determines that the first printer has appropriate printer resources to complete print job 34 and processes the entire print job. In another embodiment, the first printer apportions print job 34 into first portion 34*a* and second portion 34*b*. At 206, the first printer processes print job 34 until it encounters portions better handled by a second printer. In one embodiment, the second printer is second printer 22, which is identified as a slave to first printer 20. The first printer processes print job 34 and first portion 34*a* while outputting color portion 34*b* to the second printer, which is better able to handle second portion 34*b*.

At 208, the first printer automatically transfers print job 34 to the second printer if the first printer is unable to complete print job 34. In one embodiment, when print job 34 is transferred to the second printer, the print media is also automatically transferred to the second printer via print media path 60 as illustrated in FIGS. 3 and 6. At 210, the second printer processes second portion 34*b* of print job 34 to complete print job 34. The outputting of print job portions and transfer of the print media continues from one printer to the next until the entire print job 34 is completed.

What is claimed is:

1. A modular printing system comprising:

a first printer having a first printer media path;

a second printer having a second printer media path; and a connector system adapted to interchangeably couple the first printer to the second printer, and align the first media path with the second media oath to allow print media to pass between the first printer and second printer;

wherein the first printer and the second printer each include a controller, and wherein the controllers are configured for communicating between the first printer and the second printer to negotiate and determine a master/slave relationship between the first printer and the second printer.

2. The system of claim 1, wherein the connector system aligns a print media path between the first printer and the second printer to allow print media to pass from the first printer to the second printer without user intervention.

3. The modular printing system of claim 1, wherein the controllers are configured to negotiate a master/slave relationship between the first printer and the second printer by collectively calculating a first value representing a summation of the first printer's attributes for acting as the master, calculating a second value representing a summation of the second printer's attributes for acting as the master, and comparing the first value to the second value.

4. The system of claim 1, further comprising:

a first printer housing;

a second printer housing, wherein the connector system is integrated into the first printer housing and the second printer housing.

5. The system of claim 4, wherein the connector system comprises a first connector cell integrated into a side of the first printer and a second connector cell integrated into a side of the second printer, the first and second connector cells adapted to connect the first printer to the second printer by connecting the first connector cell to the second connector cell.

6. The system of claim 5, wherein the first connector cell is a male connector and the second connector cell is a female connector.

7. A printing system, comprising:

a first printer including a first controller;

a second printer including a second controller; and a print media path configured to transfer print media from the first printer to the second printer without user intervention;

wherein the first and second controllers are configured for communication with one another to negotiate and determine a master/slave relationship between the first printer and the second printer.

8. The system of claim 7, wherein the print media path comprises a plurality of print media inputs.

9. The system of claim 7, wherein the print media path comprises a plurality of print media outputs.

10. The printing system of claim 7, wherein the first and second controllers are configured to negotiate a master/slave relationship between the first printer and the second printer by collectively calculating a first value representing a summation of the first printer's attributes for acting as the master, calculating a second value representing a summation of the second printer's attributes for acting as the master, and comparing the first value to the second value.

11. The system of claim 7, wherein the first printer and the second printer each include a print media input and a print media output.

12. The system of claim 11, wherein the print media output of the first printer is adapted to provide print media to the print media input of the second printer without user intervention.

13. A method for configuring a modular printing system, the method comprising:

providing a first printer;

providing a second printer;

connecting the first printer to the second printer to provide a communication link between the first and the second printers and to provide a print media path between the first and second printers;

negotiating between the first printer and the second printer via the communication link to determine which one of the first and second printers will be a master printer; and designating the first and second painters as one of the master and a slave based upon the determination.

14. The method of claim 13, wherein the first printer is one of an input module, printer, and finishing module.

15. The method of claim 13, wherein the first printer is a printer and the second printer is one of an input module and finishing module, the method further comprising:

designating the first printer as the master; and designating the second printer as the slave.

16. The method of claim 13, further comprising:

sending a printer capability listing from the printer designated the slave to the printer designated the master.

17. The method of claim 13, wherein negotiating between the first printer and the second printer via the communication link to determine which one of the first and second printers will be a master printer comprises:

calculating a first value representing a summation of the first printer's attributes for acting as the master; and calculating a second value representing a summation of the second printer's attributes for acting as the master; and comparing the first value to the second value.

18. The method of claim 17, wherein the first and second printer's attributes comprise at least one of controller type, memory type, available I/O, and additional circuits.

19. The method of claim 17, wherein if the first value is equal to the second value, negotiating between the first printer and the second printer via the communication link to determine which one of the first and second printers wiD be a master printer further comprises:

generating a first random number for the first printer;

generating a second random number for the second printer; and comparing the first random number to the second random number.

* * * * *

UNITED STATES PATENT AND TRADEMARK OFFICE

CERTIFICATE OF CORRECTION

PATENT NO. : 7,070,250 B2
APPLICATION NO. : 10/706387
DATED : July 4, 2006
INVENTOR(S) : Samuel M. Lester et al.

It is certified that error appears in the above-identified patent and that said Letters Patent is hereby corrected as shown below:

In column 10, line 15, in Claim 1, after “media” delete “oath” and insert -- path --, therefor.

In column 11, line 25, in Claim 13, delete “painters” and insert -- printers --, therefor.

In column 12, line 11, in Claim 17, after “master;” delete “and”.

In column 12, line 23, in Claim 19, after “printers” delete “wiD” and insert -- will --, therefor.

Signed and Sealed this

Twenty-sixth Day of May, 2009

John Doll

JOHN DOLL
*Acting Director of the United States Patent and Trademark Office*